US009004031B1

(12) United States Patent
Choi

(10) Patent No.: US 9,004,031 B1
(45) Date of Patent: Apr. 14, 2015

(54) CONNECTING STRUCTURE OF MULTIPLE VARIABLE VALVE LIFT APPARATUS

(71) Applicant: Hyundai Motor Company, Seoul (KR)

(72) Inventor: Byong Young Choi, Gyeonggi-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/144,288

(22) Filed: Dec. 30, 2013

(30) Foreign Application Priority Data

Oct. 16, 2013 (KR) ..... 10-2013-0123452

(51) Int. Cl.

| | |
|---|---|
| ***F01L 1/34*** | (2006.01) |
| ***F02D 13/02*** | (2006.01) |
| ***F01L 1/344*** | (2006.01) |
| *F01L 1/047* | (2006.01) |

(52) U.S. Cl.
CPC ..... *F02D 13/02* (2013.01); *F01L 1/34413* (2013.01); *F01L 2001/0473* (2013.01); *F02D 13/0207* (2013.01); *F02D 13/0211* (2013.01)

(58) Field of Classification Search
CPC ..... F01L 1/34413; F01L 2001/0473; F02D 13/02; F02D 13/0207; F02D 13/0211
USPC ..... 123/90.16, 90.18, 90.6; 29/888.1
See application file for complete search history.

(56) References Cited

U.S. PATENT DOCUMENTS

| | | | | |
|---|---|---|---|---|
| 7,404,383 | B2 * | 7/2008 | Elendt | 123/90.16 |
| 7,409,938 | B2 | 8/2008 | Dengler | |
| 7,597,078 | B2 | 10/2009 | Kroos et al. | |
| 7,699,032 | B2 | 4/2010 | Muller et al. | |

FOREIGN PATENT DOCUMENTS

| | | |
|---|---|---|
| DE | 101 48 243 A1 | 4/2003 |
| KR | 10-1999-019383 | 3/1999 |

* cited by examiner

*Primary Examiner* — Ching Chang
(74) *Attorney, Agent, or Firm* — Mintz Levin Cohn Ferris Glovsky and Popeo, P.C.; Peter F. Corless

(57) ABSTRACT

A variable valve lift apparatus that has a simplified configuration is provided. The apparatus includes a camshaft and first and second cam forming portions inserted with the cam shaft to rotate together with the camshaft and be movable in a shaft direction of the camshaft, and includes an upper cam and a lower cam. A valve opening/closing device is actuated by the upper cam or the lower cam. First and second moving units are inserted with the camshaft and are movable together with the cam forming portions. First and second actuating units selectively move the moving units in the shaft direction of the camshaft and are mounted on a mounting portion. A positioning unit is connected with the moving units, and has first and second grooves. A stopper unit is mounted on the mounting portion, and is selectively inserted into the grooves to align the cam forming portions.

10 Claims, 12 Drawing Sheets

CONNECTING STRUCTURE OF MULTIPLE VARIABLE VALVE LIFT APPARATUS

CROSS-REFERENCE TO RELATED APPLICATION

This application claims priority to and the benefit of Korean Patent Application No. 10-2013-0123452 filed in the Korean Intellectual Property Office on Oct. 16, 2013, the entire contents of which are incorporated herein by reference.

BACKGROUND (a) Field of the Invention

The present invention relates to a variable valve lift apparatus, and more particularly, to a connecting structure of a variable valve lift apparatus.

(b) Description of the Related Art

In general, an internal combustion engine combusts fuel and air received in a combustion chamber to form motive power. In particular, an intake valve is actuated by driving a camshaft when air is suctioned and air enters the combustion chamber while the intake valve is opened. Further, an exhaust valve is actuated by driving the camshaft when air is discharged and air is discharged from the combustion chamber while the exhaust valve is opened.

Meanwhile, an optimal operation of the intake valve or the exhaust valve depends on a revolutions per minute (RPM) of an engine. In other words, an appropriate opening/closing timing of a lift or a valve is controlled based on the RPM of the engine. Accordingly, to implement an appropriate valve operation according to the RPM of the engine, a variable valve lift (VVL) apparatus has been researched, and a valve operates as a different lift depending on the RPM of the engine. In a variable lift apparatus in which a relative position of a cam lob to the camshaft varies among the variable valve lift apparatuses, the variable valve lift apparatus may be stably actuated by adjusting the position of the cam lob.

The above information disclosed in this section is merely for enhancement of understanding of the background of the invention and therefore it may contain information that does not form the prior art that is already known in this country to a person of ordinary skill in the art.

SUMMARY

The present invention provides a connecting structure of a variable valve lift apparatus that may control the position of a cam lob of a variable valve lift apparatus more accurately in which a relative position of a cam lob to a camshaft may vary.

An exemplary embodiment of the present invention provides a variable valve lift apparatus that may include: a camshaft; first and second cam forming portions inserted with the cam shaft to rotate together with the camshaft and be movable in a shaft direction of the camshaft, and having an upper cam and a lower cam; a valve opening/closing device actuated by either the upper cam and the lower cam; first and second moving units inserted with the camshaft and movable together with the first and second cam forming portions; first and second actuating units that selectively move the first and second moving units in the shaft direction of the camshaft and may be mounted on a mounting portion; a positioning unit connected with each of the first and second moving units, and having first and second grooves; and a stopper unit mounted on the mounting portion, and selectively inserted into the first and second grooves to align the first and second cam forming portions.

The mounting portion may be a cylinder head or a cylinder head cover. The stopper unit may include a compression spring joined to the mounting portion; and a stopper body elastically supported on the compression spring and selectively inserted into the first and second grooves. The variable valve lift apparatus may further include a linking unit inserted with the camshaft and disposed to be movable in the shaft direction of the camshaft between the first and second cam forming portions.

First and second inner guide portions may be formed in the first and second moving units, respectively to guide movement of the linking unit, the linking unit may be movable in the shaft direction of the camshaft on the first and second inner guides, and first and second contact walls that selectively contact the linking unit may be formed in the first and second moving units, respectively. Further, a C-ring fastening portion may be formed on an inner periphery of the linking unit, a C-ring may be inserted into the C-ring fastening portion, and first and second inclination grooves may be formed in the first and second inner guides to be inclined, respectively to cause the linking unit to contact one of the first and second contact walls by elastic force of the C-ring.

The first and second actuating units may be solenoids. Each of the first and second cam forming portions and the first and second moving units may be integrally formed. In addition, each of the first and second moving units and the positioning unit may be integrally formed. Each of the first and second cam forming portions, the first and second moving units, and the positioning unit may be integrally formed.

According to exemplary embodiments of the present invention, efficient actuation may be possible with a simplified configuration by a pin actuating device and a linking unit that moves in a shaft direction of a camshaft by actuation of the pin actuating device. Further, cam forming portions disposed in different cylinders may be actuated stepwise by the linking unit to prevent interference among components. Additionally, the number of solenoids may be reduced to improve spatial utilization and reduce manufacturing costs.

Figure 1:
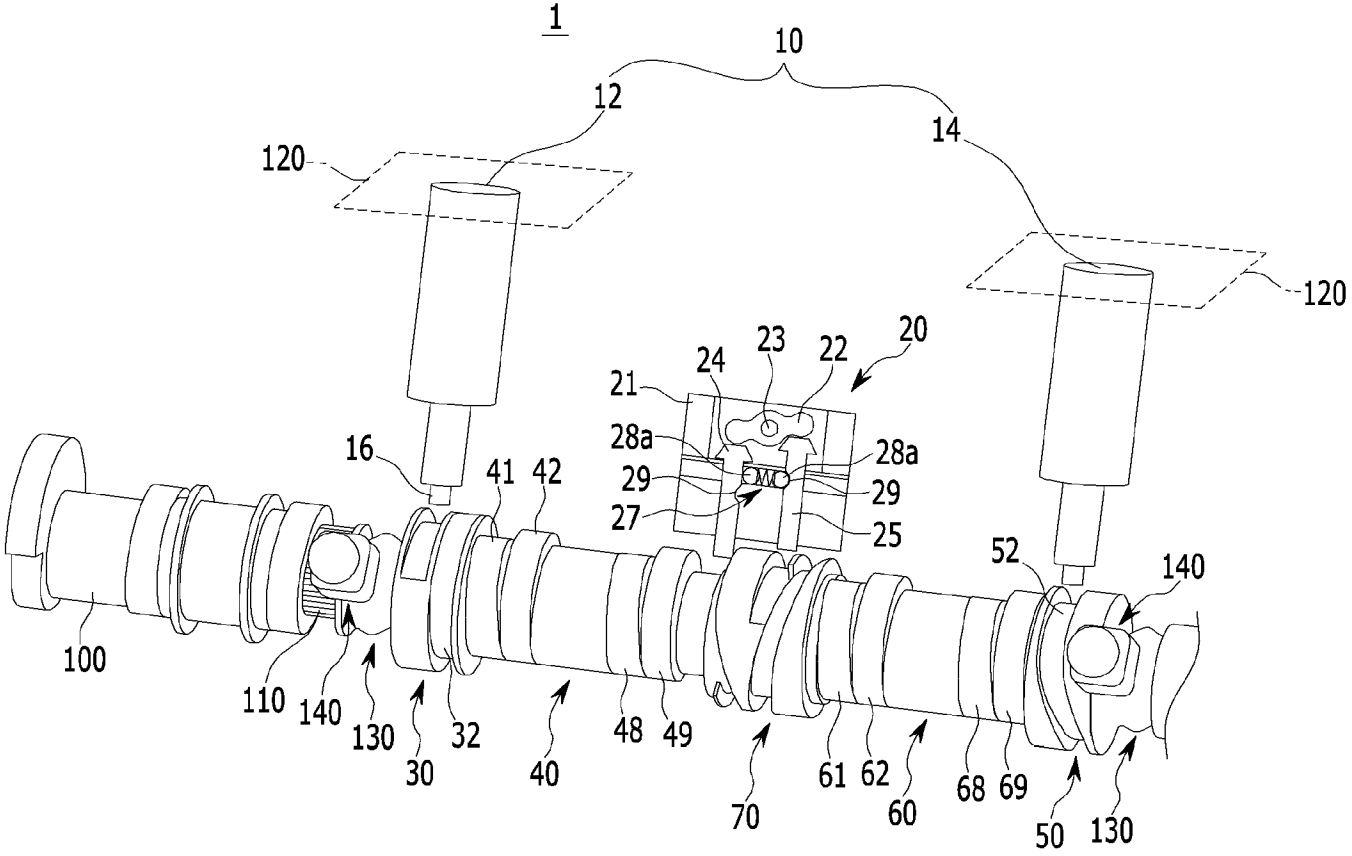
FIG. 1 is an exemplary configuration diagram of a variable valve lift apparatus according to an exemplary embodiment of the present invention.

| Description of symbols | |
|---|---|
| 1: Variable valve lift apparatus | 5: Valve opening/closing device |
| 10: Solenoid | 16, 18: Connection pin |
| 20: Pin actuating device | 22: Hinge unit |
| 24: First actuating pin | 25: Second actuating pin |
| 30: Low lift moving unit | 32, 52, 72: Guide rail |
| 40, 60, 80: Cam forming portion | 41, 48, 61, 68, 81, 88: Lower cam |
| 42, 49, 62, 69, 82, 89: Upper cam | |
| 50: High lift moving unit | |
| 70: Linking unit | 100: Camshaft |
| 110: Camshaft spline | |
| 120: Cylinder head or cylinder head cover | |
| 130: Positioning unit | 132: First groove |
| 134: Second groove | 140: Stopper unit |
| 142: Compression spring | 144: Stopper body |
| 151: First inner guide | 153: Second inner guide |
| 155: First contact wall | 157: Second contact wall |
| 160: C-ring fastening portion | 162: C-ring |
| 170: First inclination groove | 172: Second inclination groove |

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

In the following detailed description, exemplary embodiments of the present invention have been shown and described, simply by way of illustration. As those skilled in the art would realize, the described exemplary embodiments may be modified in various different ways, all without departing from the spirit or scope of the present invention. Like reference numerals designate like elements throughout the specification. In the drawings, the thickness of layers, films, panels, regions, etc., are exaggerated for clarity. When it is described that a certain part such as a layer, a film, a region and a plate is located on another part, it means that the certain part may be located directly on the another part and a third part may be interposed therebetween as well. In contrast, when an element is referred to as being "directly on" another element, there are no intervening elements present.

An exemplary embodiment of the present invention will hereinafter be described in detail with reference to the accompanying drawings. FIG. 1 is an exemplary configuration diagram of a variable valve lift apparatus according to an exemplary embodiment of the present invention. As illustrated in FIG. 1, a variable valve lift apparatus 1 according to an exemplary embodiment of the present invention may include a camshaft 100, cam forming portions 40 and 60, an actuating unit, and moving units 30 and 50.

The camshaft 100 may be a shaft that rotates with rotation of a crankshaft (not illustrated) of an engine. Since the camshaft 100 is apparent to those who have general knowledge in corresponding technical field (hereinafter, referred to as those skilled in the art), a more detailed description will be omitted. The cam forming portions 40 and 60 as parts where cams 41, 42, 48, 49, 61, 62, 68, and 69 opening and closing an intake valve or an exhaust valve of the engine may be formed have a hollow pillar shape of a predetermined thickness. Further, the camshaft 100 may be inserted into the hollows of the cam forming portions 40 and 60.

In particular, the hollows of the cam forming portions 40 and 60 may be a circular shape that corresponds to an outer periphery of the camshaft 100. Inner peripheral surfaces of the cam forming portions 40 and 60 may slide on an outer peripheral surface of the camshaft 100 to move in a shaft direction of the cam shaft 100. Further, the cam forming portions 40 and 60 may rotate together with the camshaft 100. Accordingly, the cam forming portions 40 and 60 may be movable in the shaft direction of the cam shaft 100, and a camshaft spline 110 may be formed on the camshaft 100 to cause the cam forming portions 40 and 60 and the camshaft 100 to rotate together.

The cam forming portions 40 and 60 may include a first cam forming portion 40 and a second cam forming portion 60. In particular, the first cam forming portion 40 may actuate a valve (not illustrated) disposed in a first cylinder and the second cam forming portion 60 may actuate a valve (not illustrated) disposed in a second cylinder. The first cam forming portion 40 may actuate two valves disposed in the first cylinder and the second cam forming portion 60 may actuate two valves disposed in the second cylinder. The variable valve lift apparatus 1 that actuates valves in two cylinders of a multicylinder engine including two cylinders (not illustrated) is illustrated in FIG. 1.

The valve may be the intake valve or the exhaust valve. The first cam forming portion 40 may include a first lower cam 41, a first upper cam 42, a second lower cam 48, a second upper cam 49, and a first connection unit 45. The first lower cam 41, the first upper cam 42, the second lower cam 48, and the second upper cam 49 may include a general cam lobe and a general cam base in which outer peripheral surfaces of cross sections have a substantially oval shape to cause one end to protrude relatively further than the other end, and the cams 41, 42, 48, and 49 push a valve opening/closing device 5 to open/close the valve. The first lower cam 41 and the first upper cam 42 may be formed adjacent to each other and the second lower cam 48 and the second upper cam 49 may be formed adjacent to each other. Further, the first lower cam 41 and the first upper cam 42 may form a couple to actuate one valve and the second lower cam 48 and the second upper cam 49 may form a couple to actuate the other one valve.

The first connection unit 45 may connect the couple of the first lower cam 41 and the first upper cam 42 and the couple of the second lower cam 48 and the second upper cam 49. In other words, the first connection unit 45 may be disposed between the couple of the first lower cam 41 and the first upper cam 42 and the couple of the second lower cam 48 and the second upper cam 49. Additionally, the first and second upper cams 42 and 49 may implement a substantially high lift of the valve and the first and second lowers cams 41 and 48 may implement a lower lift of the valve. In other words, in the first cam forming portion 40, the first and second upper cams 42 and 49 or the first and second lower cams 41 and 48 actuating the valve with movement in the shaft direction of the camshaft 100 selectively contact the valve opening/closing device 5.

The second cam forming portion 60 may include a third lower cam 61, a third upper cam 62, a fourth lower cam 68, a fourth upper cam 69, and a second connection unit 65. Herein, a description of the third lower cam 61, the third upper cam 62, the fourth lower cam 68, the fourth upper cam 69, and the second connection unit 65 corresponds to a description of the first lower cam 41, the first upper cam 42, the second lower cam 48, the second upper cam 49, and the first connection unit 45, and as a result a duplicated description will be omitted.

The actuating unit may be a solenoid 10. The solenoid 10 may move the first cam forming portion 40 or the second cam forming portion 60 in the shaft direction of the camshaft 100. Herein, since a configuration and actuation of the solenoid 10 that is on or off by electric control are apparent to those skilled in the art, a more detailed description will be omitted.

The moving units 30 and 50 may have a hollow pillar shape together with the first and second cam forming portions 40 and 60, inner peripheral surfaces thereof may slide on the outer peripheral surface of the shaft 100 to move in the shaft direction of the camshaft 100 and may rotate together with the camshaft 100. The solenoid 10 may include a low lift solenoid 12 and a high lift solenoid 14, and the moving units 30 and 50 may include a low lift moving unit 30 and a high lift moving unit 50.

The cam forming portion 40 illustrated at a left side of the figure is called the first cam forming portion 40 and the cam forming portion 60 illustrated at a right side of the figure is called the second cam forming portion 60 for ease of description. Further, the moving unit 30 formed at the left side of the figure is called the first moving unit 30 or the low lift moving unit 30 and the moving unit 50 formed at the right side of the figure is called the second moving unit 50 or the high lift moving unit 50.

Furthermore, the low lift moving unit 30 may be formed integrally with the first cam forming portion 40 or may be driven together with the first cam forming portion 40. Further, the low lift moving unit 30 that rotates together with the camshaft 100 may move in one direction (e.g., the right side of the figure) in the shaft direction of the camshaft 100 by actuation of the low lift solenoid 12. For ease of description, one direction in which the low lift moving unit 30 moves may be expressed as a forward direction to implement the low lift of the valve.

The high lift moving unit 50 may be formed integrally with the second cam forming portion 60 or may be driven together with the second cam forming portion 60. Further, the high lift moving unit 50 that rotates together with the camshaft 100 may move in the other direction (e.g., the left side of the figure) in the shaft direction of the camshaft 100 by actuation of the high lift solenoid 14. For ease of description, the solenoid 12 illustrated at the left side of the figure may be called the low lift solenoid 12 or the first solenoid 12 and the solenoid 14 illustrated at the right side of the figure may be called the high lift solenoid 14 or the second solenoid 14. The first and second solenoids 12 and 14 may be mounted on a mounting portion 120. In particular, the mounting portion 120 may be a cylinder head or a cylinder head cover. Further, for ease of description, the other direction in which the high lift moving unit 50 moves may be expressed as a backward direction so as to implement the high lift of the valve.

The variable valve lift apparatus 1 according to the exemplary embodiment of the present invention may further include a linking unit 70 and a pin actuating device 20. The linking unit 70 may have the hollow pillar shape and the camshaft 100 may be inserted into a hollow of the linking unit 70. An inner peripheral surface of the linking unit 70 may slide on the outer peripheral surface of the camshaft 100, and as a result, the linking unit 70 may move in the shaft direction of the camshaft 100 and may rotate together with the camshaft 100.

The linking unit 70 may be disposed between the first cam forming portion 40 which may be integrally formed and the second cam forming portion 60 which may be integrally formed. The linking unit 70 may be actuated to move in the forward direction when the low lift moving unit 30 moves in the forward direction. Further, the linking unit 70 may push the high lift moving unit 50 when the linking unit 70 is actuated to move in the forward direction. In addition, the linking unit 70 may be actuated to move in the backward direction when the high lift moving unit 50 moves in the backward direction. Further, the linking unit 70 may push the low lift moving unit 30 when the linking unit 70 is actuated to move in the backward direction.

The pin actuating device 20 may be configured to move the linking unit 70 in the shaft direction of the camshaft 100. Further, the pin actuating device 20 may include a housing 21, a hinge unit 22, a first actuating pin 24, a second actuating pin 25, and a pin fixing unit 27. The housing 21 may be a body of the pin actuating device 20 on which the hinge unit 22, the first actuating pin 24, the second actuating pin 25, and the pin fixing unit 27 may be mounted. The hinge unit 22 may be configured to hinge-move around a hinge shaft 23 fixed to the housing 21.

Furthermore, the first actuating pin 24 and the second actuating pin 25 may have a bar shape that elongates in one direction. The first actuating pin 24 may be pushed by the hinge unit 22 with the hinge-movement of the hinge unit 22 to move in a direction to protrude from the housing 21. Additionally, when the first actuating pin 24 moves to an original position, the hinge unit 22 may be pushed by the first actuating pin 24, and as a result, the hinge unit 22 may hinge-move contrary thereto. Moreover, when the hinge unit 22 hinge-moves contrary thereto, the second actuating pin 25 may be pushed by the hinge unit 22 to move in the direction to protrude from the housing 21. In other words, when the pin actuating device 20 moves to the original position to prevent one of the first actuating pin 24 and the second actuating pin 25 from protruding from the housing 21, the first and second actuating pins 24 and 25 may be linked by the hinge unit 22 to cause the other to protrude from the housing 21.

The pin fixing unit 27 may be configured to fix a pin which moves to the original position between the first and second actuating pins 24 and 25. A suspending groove 29 may be formed in the first and second actuating pins 24 and 25 to be suspended with the pin fixing unit 27 while the first actuating pin 24 or the second actuating pint 25 moves to the original position. The pin fixing unit 27 may include a spring 28 and a check ball **28*a*, and the check ball 28*a* may be inserted into the suspending groove 29 of one of the first and second actuating pins 24 and 25 by relatively small force pushed by the spring 28 and the check ball 28*a* may be separated from the suspending groove 29 by relatively large force actuated by the first and second actuating pins 24 and 25**.

Figure 2:
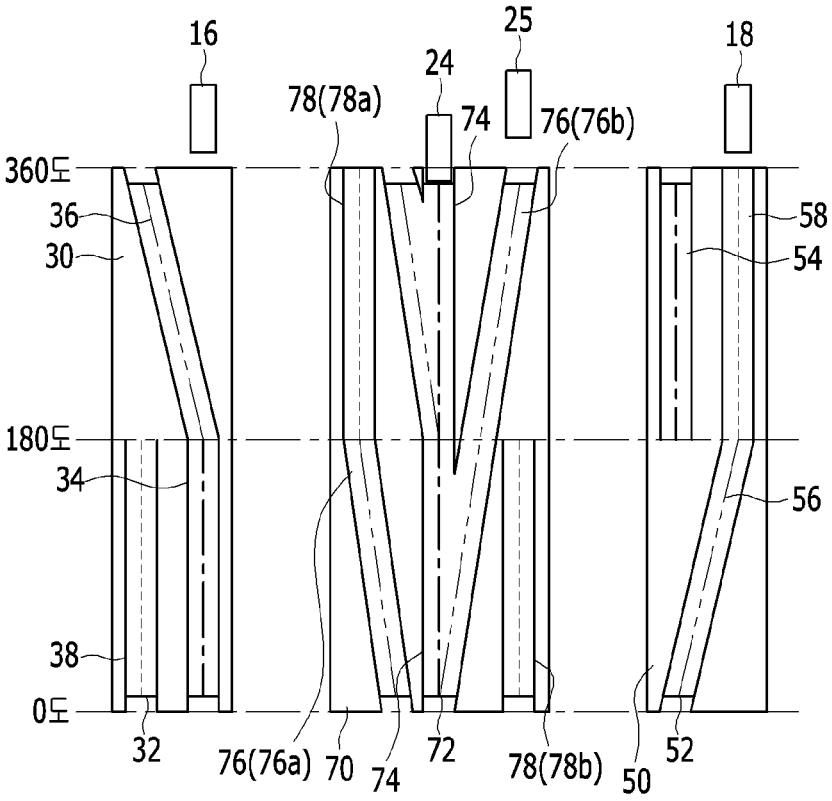
FIG. 2 is an exemplary detailed view of a moving unit and a linking unit of the variable valve lift apparatus according to the exemplary embodiment of the present invention.

FIG. 2 is an exemplary detailed view of a moving unit and a linking unit according to the exemplary embodiment of the present invention. As illustrated in FIG. 2, the low lift moving unit 30, the high lift moving unit 50, and the linking unit 70 may include guide rails 32, 52, and 72, respectively.

The guide rail 72 of the linking unit 70 may contact (e.g., connect to) the first actuating pin 24 or the second actuating pin 25 that protrudes from the housing 21 with actuation of the pin fixing unit 27 to guide a motion of the linking unit 70. In other words, when the first actuating pin 24 or the second actuating pin 25 is inserted into the guide rail 72 of the linking unit 70, the guide rail 72 may guide a relative motion of the first actuating pin 24 or the second actuating pin 25, and as a result, the linking unit 70 may move in the shaft direction of the camshaft 100.

The low lift solenoid 12 may include a first connection pin 16 that protrudes in the bar shape, and when the first connection pin 16 protrudes with actuation of the low lift solenoid 12, the first connection pin 16 may be inserted into the guide rail 32 of the low lift moving unit 30. Further, the guide rail 32 of the low lift moving unit 30 may contact (e.g., connect to) the first connection pin 16 to guide a motion of the low lift moving unit 30. In other words, when the first connection pin 16 is inserted into the guide rail 32 of the low lift moving unit 30, the guide rail 32 of the low lift moving unit 30 may guide a relative motion of the first connection pin 16, and as a result, the low lift moving unit 30 may move in the forward direction in the shaft direction of the camshaft 100.

The high lift solenoid 14 may include a second connection pin 18 that protrudes in the bar shape, and when the second connection pin 18 protrudes with the high lift solenoid 14, the second connection pin 18 may be inserted into the guide rail 52 of the high lift moving unit 50. Further, the guide rail 52 of the high lift moving unit 50 may contact the second connection pin 18 to guide a motion of the high lift moving unit 50. In other words, when the second connection pin 18 is inserted into the guide rail 52 of the high lift moving unit 50, the guide rail 52 may guide a relative motion of the second connection pin 18, and as a result, the high lift moving unit 50 may move in the backward direction in the shaft direction of the camshaft 100.

The guide rails 32, 52, and 72 may have a groove shape dented from outer peripheral surfaces of the moving units 30 and 50, and the linking unit 70. The guide rails 32, 52, and 72 may include connection sections 34, 54, and 74, moving sections 35, 56, and 76, and separation sections 38, 58, and 78. The connection sections 34, 54, and 74 may be sections in which respective contacts with the first and second connection pins 16 and 18 and the first and second actuating pins 24 and 25 start. Further, the connection sections 34, 54, and 74 may be formed on outer peripheries of the low lift moving unit 30, the high lift moving unit 50, and the linking unit 70 vertically to the shaft direction of the camshaft 100.

The moving sections 36, 56, and 76 may be sections formed to guide shaft-direction movement of the camshaft 100 of the low lift moving unit 30, the high lift moving unit 50, and the linking unit 70 by the first and second connection pins 16 and 18 and the first and second actuating pins 24 and 25 that contact in the connection sections 34, 54, and 74. Further, the moving sections 36, 56, and 76 may be formed to be inclined at a predetermined inclination (e.g., a predetermined angle) based on the shaft direction of the camshaft 100.

The separation sections 38, 58, and 78 may be sections formed to separate the first and second connection pins 16 and 18 and the first and second actuating pins 24 and 25 from the guide rails 32, 52, and 72, respectively. In other words, the separation sections 38, 58, and 78 may be sections in which respective contacts with the first and second connection pins 16 and 18 and the first and second actuating pins 24 and 25 end. Further, the separation sections 38, 58, and 78 may be formed on the outer peripheries of the low lift moving unit 30, the high lift moving unit 50, and the linking unit 70 vertically to the shaft direction of the camshaft 100.

In FIG. 2, references of a 0-degree line, a 180-degree line, and a 360-degree line may be set on the outer peripheries of the low lift moving unit 30, the high lift moving unit 50, and the linking unit 70 and detailed views of the outer peripheries of the low lift moving unit 30, the high lift moving unit 50, and the linking unit 70 are illustrated to illustrate shapes of the guide rails 32, 52, and 72 on one surface from the 0-degree line to the 360-degree line. Further, the set 0-degree line, 180-degree line, and 360-degree line are expressed by virtual lines. Moreover, the connection sections 34, 54, and 74 are expressed by a 1-dot chain line, the moving sections 36, 56, and 76 are expressed by a 2-dot chain line, and the separation sections 38, 58, and 78 are expressed by a dotted line.

The connection section 34 of the low lift moving unit 30 may be formed from the 0-degree line to the 180-degree line. Further, the moving section 36 of the low lift moving unit 30 may be formed to be inclined in the background direction from the connection section 34. Moreover, the separation section 38 of the low lift moving unit 30 may connect with the moving section 36 on the 0-degree line (360-degree line) and may be extended from the 0-degree line to the 180-degree line. In particular, when the moving section 36 is inclined in the backward direction, and as a result, the first connection pin 16 is inserted, the low lift moving unit 30 may be moved in the forward direction by rotation of the camshaft 100.

The connection section 54 of the high lift moving unit 50 may be formed from the 180-degree line to the 360-degree line. The connection section 54 of the high lift moving unit 50 may be formed from the 180-degree line to the 360-degree line. Moreover, the separation section 58 of the high lift moving unit 50 may connect with the moving section 56 on the 180-degree line and may be formed from the 180-degree line to the 360-degree line. In particular, when the moving section 56 is inclined in the forward direction, and as a result, the second connection pin 18 is inserted, the high lift moving unit 50 may be moved in the backward direction by rotation of the camshaft 100.

The moving section 76 of the linking unit 70 may include a first moving section **76*a* formed in the backward direction and a second moving section 76*b* formed in the forward direction based on the connection section 74. In particular, two moving sections 76 of the linking unit 70 may be formed to selectively move the linking unit 70 in the forward direction or the backward direction by rotation of the camshaft 100. Moreover, as two moving sections 76 of the linking unit 70 are formed, two separation sections 78 of the linking unit 70** may also be formed.

The connection section 74 of the linking unit 70 may be formed from the 0-degree line to 180-degree line at a shaft-direction center of the outer periphery of the linking unit 70. Further, one moving section **76*a* of the linking unit 70 may be branched from the connection section 74 on the 180-degree line and may be inclined in the backward direction up to the 180-degree line again and continuously extended. Moreover, a first separation section 78*a* of the linking unit 70 may connect with the one moving section 76*a*** on the 180-degree line and may be extended from the 180-degree line to the 360-degree line.

Moreover, the second moving section **76*b* of the linking unit 70 may be branched from the connection section 74 on the 0-degree line (the 360-degree line) and inclined in the forward direction from the 0-degree line to the 360-degree line and extended. Further, a second separation section 78***b* of the linking unit 70 may connect with the other moving section 76*b* on the 0-degree line (the 360-degree line) and may be extended from the 0-degree line to the 180-degree line. In particular, the first moving section 76*a* inclined in the backward direction may guide the motion of the linking unit 70 to cause the linking unit 70 to move in the forward direction by rotation of the camshaft 100 and the second moving section 76*b* inclined in the forward direction may guide the motion of the linking unit 70 to move the linking unit 70 in the backward direction by rotation of the camshaft 100.

In the above description, 0 degree, 180 degree, and 360 degree may be set for ease of description and the variable valve lift apparatus according to the exemplary embodiment of the present invention is not limited thereto.

Figure 3:
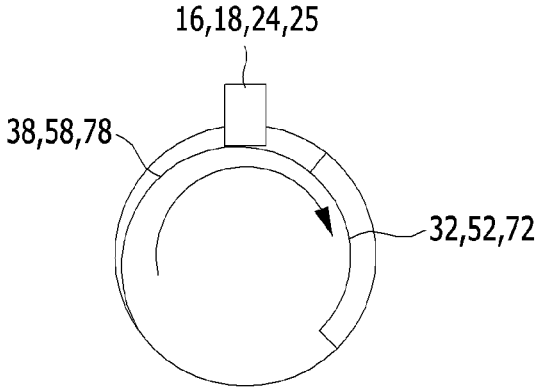
FIG. 3 is an exemplary cross-sectional view of the moving unit and the linking unit of the variable valve lift apparatus according to the exemplary embodiment of the present invention.

FIG. 3 is an exemplary cross-sectional view of a moving unit and a linking unit according to the exemplary embodiment of the present invention. As illustrated in FIG. 3, the separation sections 38, 58, and 78 may be formed in which a depth of a groove dented from the outer peripheral surface of the moving units 30 and 50 and the linking unit 70 may gradually decrease in a direction extended from points where the separation sections 38, 58, and 78 of the guide rails 32, 52, and 72 connect the moving sections 36, 56, and 76. In other words, the depth of the groove may gradually decrease until surfaces of the separation sections 38, 58, and 78 that contact the first and second connection pins 16 and 18 and the first and second actuating pins 24 and 25 reach the outer peripheral surfaces of the moving units 30 and 50 and the linking unit 70. Accordingly, the first and second connection pins 16 and 18 and the first and second actuating pins 24 and 25 may be smoothly separated from the guide rails 32, 52, and 72.

Figure 4:
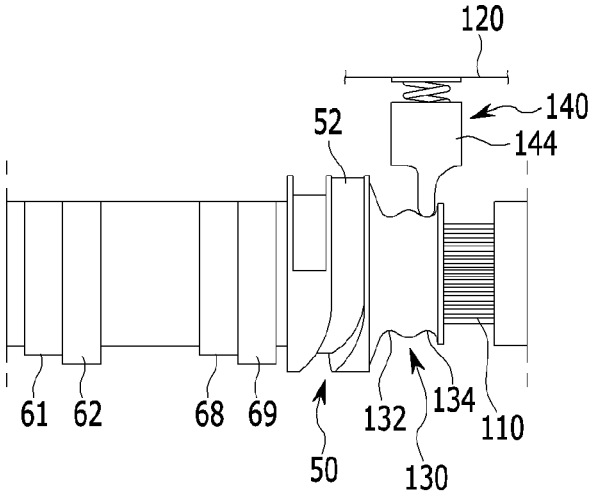
FIG. 4 is an exemplary diagram illustrating a positioning unit of the variable valve lift apparatus according to an exemplary embodiment of the present invention.
Figure 5:
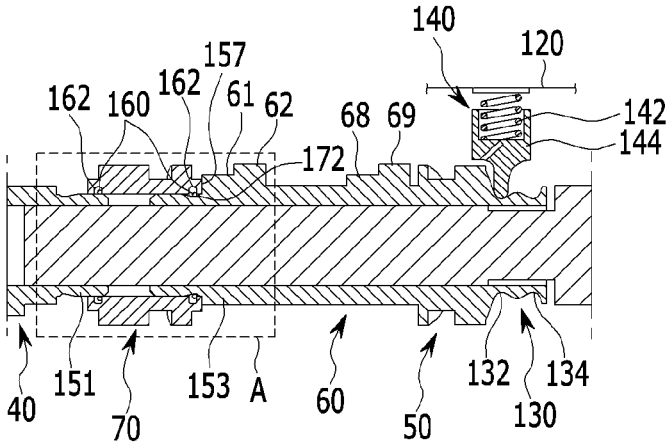
FIG. 5 is an exemplary cross-sectional view of FIG. 4 according to an exemplary embodiment of the present invention.
Figure 6:
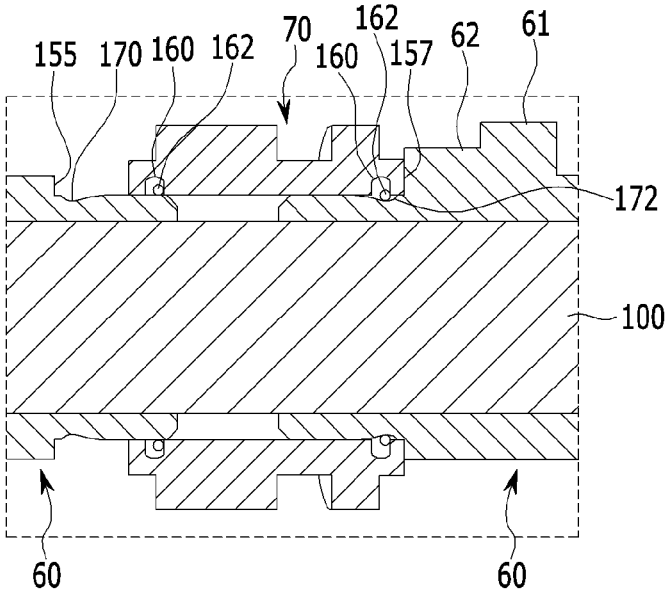
FIG. 6 is an exemplary detailed view of part A of FIG. 5 according to an exemplary embodiment of the present invention.

FIG. 4 is an exemplary diagram illustrating a positioning unit of the variable valve lift apparatus according to the exemplary embodiment of the present invention. FIG. 5 is an exemplary cross-sectional view of FIG. 4. FIG. 6 is an exemplary detailed view of part A of FIG. 5. Referring to FIGS. 4 to 6, the variable valve lift apparatus according to the exemplary embodiment of the present invention may further include the positioning unit 130 and the mounting portion 120 connected with the first and second moving units 30 and 50, respectively, and the stopper unit 140 may have first and second grooves 132 and 134, and may be selectively inserted into the first and second grooves 132 and 134 to align the first and second moving units 30 and 50.

The positioning unit 130 may be connected with each of the first and second moving units 30 and 50 or formed integrally with each of the first and second moving units 30 and 50. Further, the positioning unit 130 may be formed integrally with each of the first and second moving units 30 and 50 and the first and second cam forming portions 40 and 60. In other words, some or all of the positioning unit 130, the first and second moving units 30 and 50, and the first and second cam forming portions 40 and 60 may be integrally formed to reduce manufacturing time and manufacturing cost.

The mounting portion 120 may be a cylinder head or a cylinder head cover, and as a result, the first and second solenoids 12 and 14 and the stopper unit 140 may be mounted on the same member. The stopper unit 140 may include a compression spring 142 joined to the mounting portion 120 and a stopper body 144 elastically supported on the compression spring 142 and selectively inserted into the first and second grooves 132 and 134.

The variable valve lift apparatus according to the exemplary embodiment of the present invention may be stably actuated by securing more precise positional management with the first and second connection pins 16 and 18 and the first and second actuating pins 24 and 25 inserted into the guide rails 32, 52, and 72. Further, positions between the cams 41, 42, 48, and 49, and the valve opening/closing device 5 may be managed more accurately.

A positional deviation between respective components may occur after variably controlling the valve lift due to a processing tolerance, thermal expansion, or the like of the respective components. However, a stopper body 144 of the stopper unit 140 may be selectively inserted into the first and second grooves 132 and 134 to align a setting position of each component even after variably controlling the valve lift. In particular, since the first and second solenoids 12 and 14, and the stopper unit 140 are mounted on the same member, a positional deviation may be minimized.

Furthermore, first and second inner guide portions 151 and 153 may be formed in the first and second moving units 30 and 50, respectively to guide a motion of the linking unit 70, the linking unit 70 may be movable in the shaft direction of the camshaft 100 on the first and second inner guides 151 and 153, and first and second contact walls 155 and 157 that selectively contact the linking unit 70 may be formed in the first and second moving units 30 and 50, respectively. A C-ring fastening portion 160 may be formed on the inner periphery of the linking unit 70 and a C-ring 162 may be inserted into the C-ring fastening portion 160.

Additionally, first and second inclination grooves 170 and 172 may be formed in the first and second inner guides 151 and 153, respectively to be inclined to connect the linking unit 70 to one of the first and second contact walls 155 and 157 by elastic force of the C-ring 162. When the linking unit 70 moves adjacent to the first contact wall 155 or the second contact wall 157, the C-ring 162 may move along the first inclination groove 170 or the second inclination groove 172 by the elastic force of the C-ring 162, and as a result, the linking unit 70 may contact the first contact wall 155 or the second contact wall 157. Accordingly, the linking unit 70 may be positioned at a set location, and as a result, stable actuation of the variable valve lift apparatus according to the exemplary embodiment of the present invention may improved. The first and second solenoids 12 and 14, and the stopper unit 140 may be mounted on the same member, and the linking unit 70 may contact the first contact wall 155 or the second contact wall 157 by the elastic force of the C-ring 162, and as a result, the positional deviation between the respective components may be minimized FIGS. 7 to 12 are exemplary actuation diagrams of the variable valve lift apparatus according to the exemplary embodiment of the present invention. Hereinafter, actuation of the variable valve lift apparatus 1 according to the exemplary embodiment of the present invention will be described in detail with reference to FIGS. 7 to 12.

Figure 7:
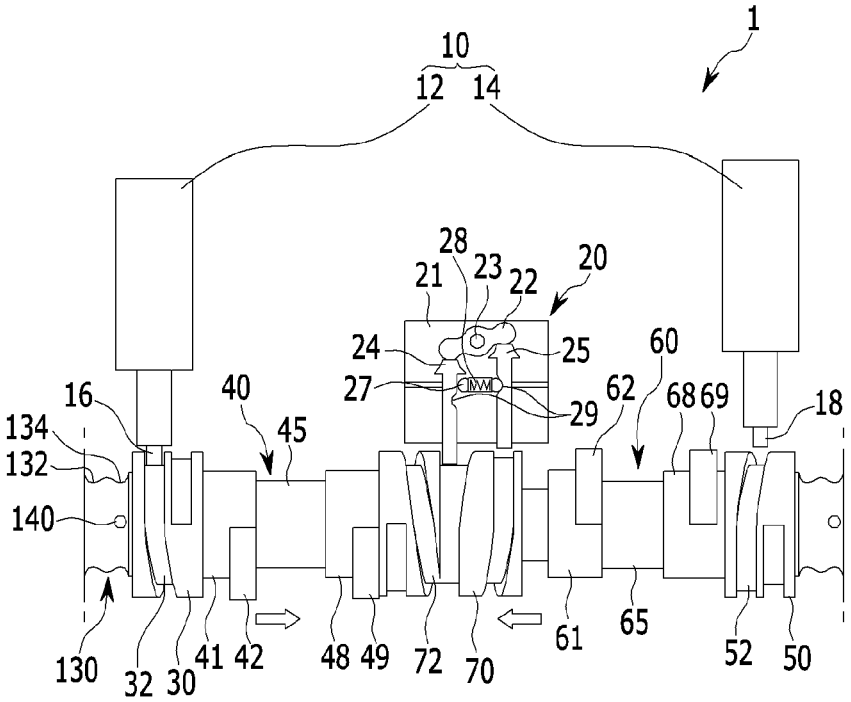
FIGS. 7 to 12 are exemplary actuation diagrams of the variable valve lift apparatus according to the exemplary embodiment of the present invention.

As illustrated in FIG. 7, a controller (not illustrated) may be configured to actuate the low lift solenoid 12 to insert the first connection pin 16 into the guide rail 32 of the low lift moving unit 3 according to an actuation of an engine. The low lift moving unit 30 and the first cam forming portion 40 may move in the forward direction and simultaneously, the first cam forming portion 40 may push the linking unit 70. In particular, as the rotating linking unit 70 is pushed in the forward direction while the first actuating pin 24 of the pin actuating device 20 is inserted into the connection section 74 of the guide rail 72 of the linking unit 70, the first actuating pin 24 may enter the one moving section 76*a* of the guide rail 72 of the linking unit 70. The first connection pin 16 may be separated from the separation section 38 while passing through the separation section 38, but the linking unit 70 may be continuously moved in the forward direction by the first actuating pin 24. The linking unit 70 moved in the forward direction may push the second cam forming portion 60. Accordingly, the second cam forming portion 60 and the high lift moving unit 50 may moved together in the forward direction.

Figure 8:
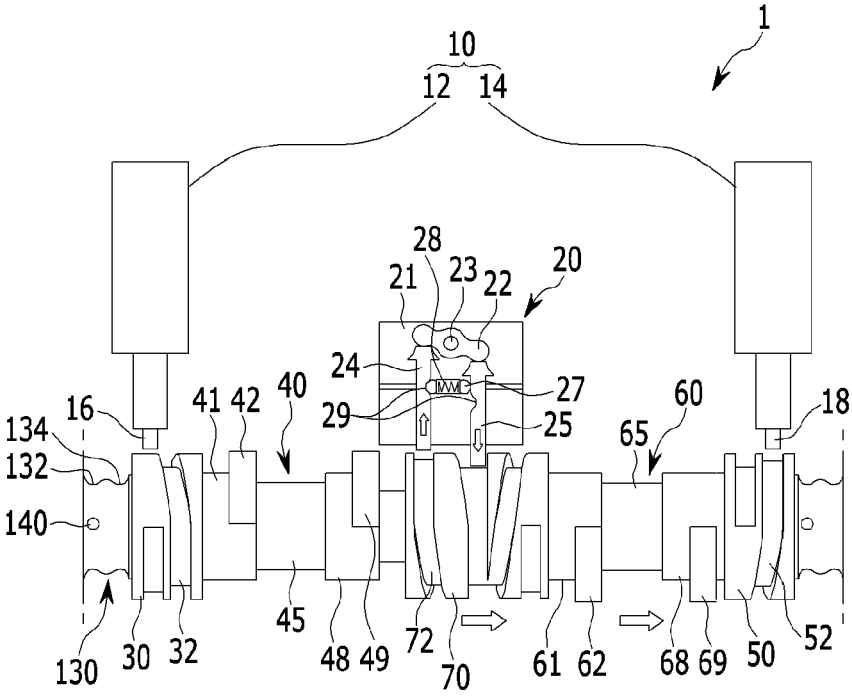

As illustrated in FIG. 8, as the linking unit 70 and the second cam forming portion 60 are continuously moved in the forward direction, the high lift moving unit 50 may be positioned to allow the connection pin 18 of the high lift solenoid 14 to be inserted into the connection section 54 of the guide rail 52 of the high lift moving unit 50. Further, the first actuating pin 24 may pass through the separation section 78*a* of the guide rail 72 of the linking unit 70, and separation of the first actuating pin 24 may be completed, the second actuating pin 25 of the pin actuating device 20 may be inserted into the connection section 74 of the guide rail 72 of the linking unit 70.

Moreover, timings at which the cam forming portions 40 and 60 disposed in each cylinder actuate the valve may be different from each other, and angles at which the cams 41, 42, 48, 49, 61, 62, 68, and 69 are formed may be different from each other. Accordingly, the first cam forming portion 40 and the second cam forming portion 60 may be sequentially movable without being simultaneously moved. In other words, as described above, in the first cam forming portion 40 and the second cam forming portion 60, the valve lift may be changed while each cam base contacts the valve opening/closing device 5. Accordingly, interference between the cam forming portions 40 and 60 and the valve opening/closing device 5 may be minimized.

The first connection pin 16 may be inserted into the guide rail 32, and as a result, the low lift moving unit 30 and the first cam forming portion 40 may be integrally moved in the forward direction and further, the first cam forming portion 40 may push the linking unit 70 in the forward direction while being moved in the forward direction. In particular, a predetermined distance in which the linking unit 70 is pushed may be a distance in which the first actuating pin 24 of the pin actuating device 20 enters the first moving section 76*a* from the connection section 74 of the guide rail 72. When the first actuating pin 24 enters the one moving section 76*a* and thereafter, the first actuating pin 24 is inserted into the first moving section 76*a* of the guide rail 72 by rotation of the linking unit 70, the linking unit 70 may be moved in the forward direction. The linking unit 70 may contact (e.g., connect with) the second cam forming portion 60 by the forward movement of the linking unit 70 after the first actuating pin 24 enters the one moving section 76*a*, and may push and move the second cam forming portion 60 in the forward direction.

Furthermore, at least one part of between the first cam forming portion and the linking unit 70 or between the second cam forming portion 60 and the linking unit 70 may be continuously spaced. In the spacing, as the linking unit 70 may be moved between the first cam forming portion 40 and the second cam forming portion 60, the first cam forming portion 40 and the second cam forming portion 60 may be continuously sequentially moved without being simultaneously moved. In addition, changes in the timings of valve lifts of the cylinder in which the first cam forming portion 40 is disposed and the cylinder in which the second cam forming portion 60 is disposed may be determined based on the spacing and shapes of the guide rails 32, 52, and 72.

FIGS. 9 to 12 are exemplary actuation diagrams of the variable valve lift apparatus 1 that moves the first and second cam forming portions 40 and 60 to open and close the valve by the first, second, third, and fourth upper cams 42, 49, 62, and 69.

Figure 9:
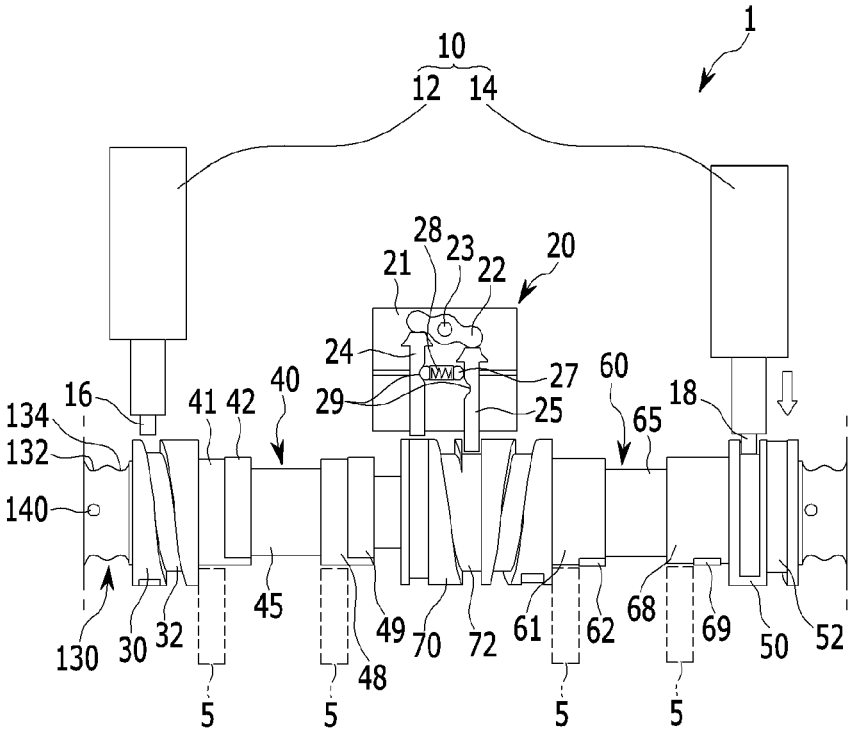
Figure 10:
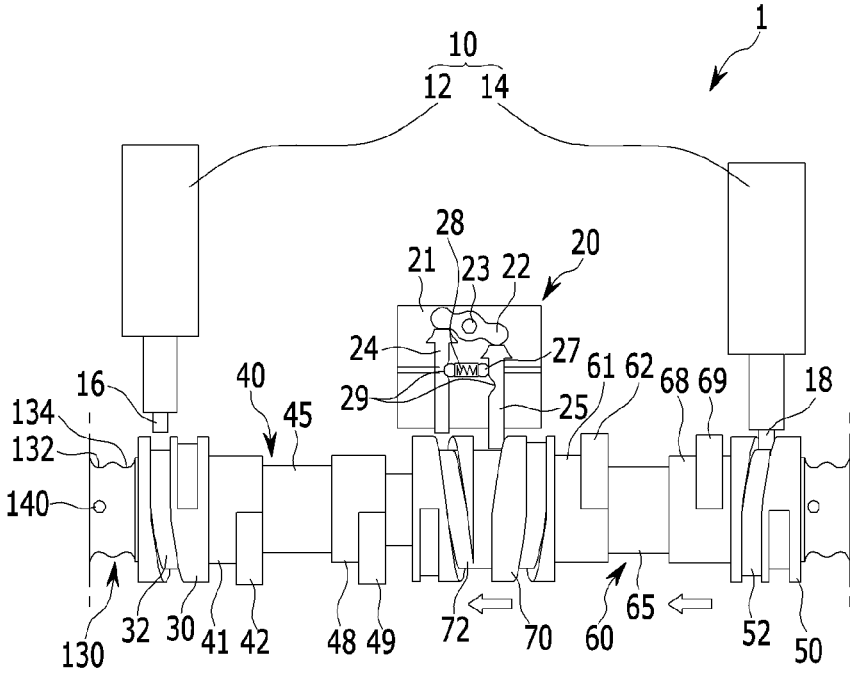
Figure 11:
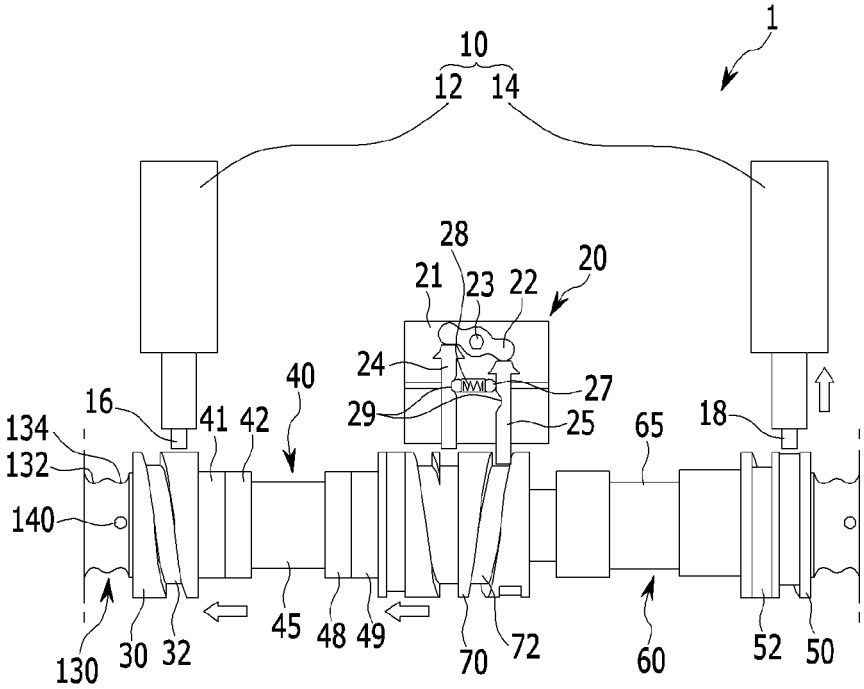

As illustrated in FIG. 9, a controller (not illustrated) may be configured to actuate the high lift solenoid 14 based on an actuation state of the engine to allow the second connection pin 18 to be inserted into the connection section 54 of the guide rail 52 of the high lift moving unit 50. As illustrated in FIGS. 10 and 11, when the connection pin 18 of the high lift solenoid 14 is inserted into the guide rail 52 of the high lift moving unit 50, the high life moving unit 50 and the second cam forming portion 60 may be moved together in the backward direction and the second cam forming portion 60 moved in the backward direction may push the linking unit 70. In particular, as the rotating linking unit 70 is pushed in the backward direction while the second actuating pin 25 of the pin actuating device 20 is inserted into the connection section 74 of the guide rail 72 of the linking unit 70, the second actuating pin 25 may enter the second moving section 76*b* of the guide rail 72 of the linking unit 70. The second connection pin 18 may be separated from the separation section 58 while passing through the separation section 58, and the linking unit 70 may be continuously moved in the backward direction by the second actuating pin 25.

Figure 12:
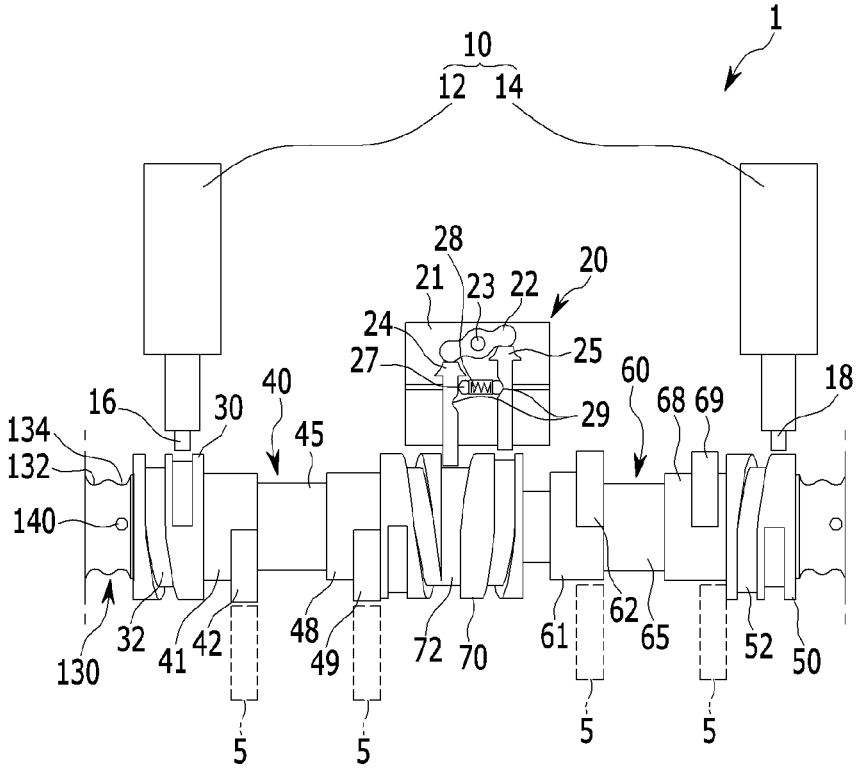

As illustrated in FIG. 12, as the linking unit 70 and the first cam forming portion 40 are continuously moved in the backward direction, the low lift moving unit 30 may be positioned to allow the connection pin 16 of the low lift solenoid 12 to contact the connection section 34 of the guide rail 32 of the low lift moving unit 30. Further, when the second actuating pin 25 passes through the separation section 78*b* of the guide rail 72 of the linking unit 70, and separation of the second actuating pin 25 is completed, the first actuating pin 24 of the pin actuating device 20 may be inserted into the connection section 74 of the guide rail 72 of the linking unit 70. In other words, components of the variable valve lift apparatus 1 may be disposed to start actuation to implement the lower lift (e.g., a lifting that is lower than the high lift, in other words the valve may be lifted at various levels). In FIG. 9, the valve opening/closing devices 5 may be positioned to roll-contact the upper cams 43, 49, 62, and 69.

Moreover, the second cam forming portion 60 and the first cam forming portion 40 may be sequentially moved without being simultaneously moved. In other words, as described above, the second cam forming portion 60, the linking unit 70, and the first cam forming portion 40 may be sequentially moved in the backward direction, and the sequential movement may allow the valve lift to be changed while the cam base contacts the valve opening/closing device 5, to minimize interference between the cam forming portions 40 and 60, and the valve opening/closing device 5.

According to exemplary embodiments of the present invention, more efficient actuation may be possible with a simplified configuration by a pin actuating device 20 and a linking unit 70 that moves in a shaft direction of a camshaft 100 by actuation of the pin actuating device 20. Further, cam forming portions 40 and 60 disposed in different cylinders may be actuated stepwise by the linking unit 70 to prevent interference among components. The number of solenoids 10 may be reduced to improve spatial utilization and reduce manufacturing cost. The first and second solenoids 12 and 14, and the stopper unit 140 may be mounted on the same member, and the linking unit 70 may contact the first contact wall 155 or the second contact wall 157 by the elastic force of the C-ring 162, and as a result, the positional deviation between the respective components may be minimized.

While this invention has been described in connection with what is presently considered to be exemplary embodiments, it is to be understood that the invention is not limited to the disclosed embodiments, but, on the contrary, is intended to cover various modifications and equivalent arrangements included within the spirit and scope of the accompanying claims.

What is claimed is:

1. A variable valve lift apparatus, comprising:

a camshaft;

a first cam forming portion and a second cam forming portion inserted with the camshaft to rotate together with the camshaft and be movable in a shaft direction of the camshaft, and having an upper cam and a lower cam;

a valve opening and closing device actuated by the upper cam or the lower cam;

a first moving unit and a second moving unit inserted with the camshaft and each movable together with the first and second cam forming portions;

a first actuating unit and a second actuating unit that selectively move the first and second moving units in the shaft direction of the camshaft and are mounted on a mounting portion;

a positioning unit connected with each of the first and second moving units, and having a first groove and a second groove; and a stopper unit mounted on the mounting portion, and selectively inserted into the first and second grooves to align the first and second cam forming portions.

2. The variable valve lift apparatus of claim 1, wherein the mounting portion is a cylinder head or a cylinder head cover.

3. The variable valve lift apparatus of claim 1, wherein the stopper unit includes:

a compression spring joined to the mounting portion; and a stopper body elastically supported on the compression spring and selectively inserted into the first and second grooves.

4. The variable valve lift apparatus of claim 1, further comprising:

a linking unit inserted with the camshaft and disposed to be movable in the shaft direction of the camshaft between the first and second cam forming portions.

5. The variable valve lift apparatus of claim 4, further comprising:

a first inner guide portion and a second inner guide portion formed in the first and second moving units, respectively to guide movement of the linking unit, wherein the linking unit is movable in the shaft direction of the camshaft on the first and second inner guides; and a first contact wall and a second contact wall that selectively contact the linking unit are formed in the first and second moving units, respectively.

6. The variable valve lift apparatus of claim 5, further comprising:

a C-ring fastening portion formed on an inner periphery of the linking unit, a C-ring inserted into the C-ring fastening portion, and a first inclination groove and a second inclination groove formed in the first and second inner guides to be inclined, respectively to cause the linking unit to contact one of the first and second contact walls by elastic force of the C-ring.

7. The variable valve lift apparatus of claim 1, wherein the first and second actuating units are solenoids.

8. The variable valve lift apparatus of claim 1, wherein each of the first and second cam forming portions and the first and second moving units is integrally formed.

9. The variable valve lift apparatus of claim 1, wherein each of the first and second moving units and the positioning unit is integrally formed.

10. The variable valve lift apparatus of claim 1, wherein each of the first and second cam forming portions, the first and second moving units, and the positioning unit is integrally formed.

* * * * *